US008463599B2

(12) United States Patent
Ramabadran et al.

(10) Patent No.: US 8,463,599 B2
(45) Date of Patent: Jun. 11, 2013

(54) BANDWIDTH EXTENSION METHOD AND APPARATUS FOR A MODIFIED DISCRETE COSINE TRANSFORM AUDIO CODER

(75) Inventors: Tenkasi Ramabadran, Naperville, IL (US); Mark Jasiuk, Chicago, IL (US)

(73) Assignee: Motorola Mobility LLC, Libertyville, IL (US)

( * ) Notice: Subject to any disclaimer, the term of this patent is extended or adjusted under 35 U.S.C. 154(b) by 891 days.

(21) Appl. No.: 12/365,457

(22) Filed: Feb. 4, 2009

(65) Prior Publication Data

US 2010/0198587 A1 Aug. 5, 2010

(51) Int. Cl.
*G10L 19/14* (2006.01)

(52) U.S. Cl.
USPC ..... 704/205; 704/206; 704/207; 704/208; 704/209

(58) Field of Classification Search
None
See application file for complete search history.

(56) References Cited

U.S. PATENT DOCUMENTS

| | | | | |
|---|---|---|---|---|
| 4,771,465 | A | | 9/1988 | Bronson et al. |
| 5,245,589 | A | | 9/1993 | Abel et al. |
| 5,455,888 | A | | 10/1995 | Iyengar et al. |
| 5,579,434 | A | | 11/1996 | Kudo et al. |
| 5,581,652 | A | | 12/1996 | Abe et al. |
| 5,794,185 | A | | 8/1998 | Bergstrom et al. |
| 5,878,388 | A | * | 3/1999 | Nishiguchi et al. ..... 704/214 |
| 5,949,878 | A | | 9/1999 | Burdge et al. |
| 5,950,153 | A | | 9/1999 | Ohmori et al. |
| 5,978,759 | A | | 11/1999 | Tsushima et al. |
| 6,009,396 | A | | 12/1999 | Nagata |
| 6,453,287 | B1 | | 9/2002 | Unno et al. |
| 6,680,972 | B1 | | 1/2004 | Liljeryd et al. |
| 6,708,145 | B1 | | 3/2004 | Liljeryd et al. |
| 6,732,075 | B1 | | 5/2004 | Omori et al. |
| 6,895,375 | B2 | | 5/2005 | Malah et al. |
| 7,181,402 | B2 | | 2/2007 | Jax et al. |
| 7,328,162 | B2 | | 2/2008 | Liljeryd et al. |
| 7,359,854 | B2 | | 4/2008 | Nilsson et al. |

(Continued)

FOREIGN PATENT DOCUMENTS

| | | | |
|---|---|---|---|
| CN | 1272259 | A | 11/2000 |
| EP | 1367566 | A2 | 12/2003 |

(Continued)

OTHER PUBLICATIONS

Hsu; Robust Bandwidth Extension of Narrowband Speech; Master thesis; Department of Electrical & Computer Engineering; McGill University, Canada; Nov. 2004.

(Continued)

*Primary Examiner* — Leonard Saint Cyr

(57) ABSTRACT

A method includes defining a transition band for a signal having a spectrum within a first frequency band, where the transition band is defined as a portion of the first frequency band, and is located near an adjacent frequency band that is adjacent to the first frequency band. The method analyzes the transition band to obtain a transition band spectral envelope and a transition band excitation spectrum; estimates an adjacent frequency band spectral envelope; generates an adjacent frequency band excitation spectrum by periodic repetition of at least a part of the transition band excitation spectrum with a repetition period determined by a pitch frequency of the signal; and combines the adjacent frequency band spectral envelope and the adjacent frequency band excitation spectrum to obtain an adjacent frequency band signal spectrum. A signal processing logic for performing the method is also disclosed.

19 Claims, 6 Drawing Sheets

U.S. PATENT DOCUMENTS

| | | | | |
|---|---|---|---|---|
| 7,461,003 | B1 | 12/2008 | Tanrikuli | |
| 7,483,758 | B2 | 1/2009 | Liljeryd et al. | |
| 7,490,036 | B2 | 2/2009 | Jasiuk et al. | |
| 7,546,237 | B2 | 6/2009 | Nongpiur et al. | |
| 7,844,453 | B2 | 11/2010 | Hetherington | |
| 8,069,040 | B2 | 11/2011 | Vos | |
| 8,229,106 | B2 | 7/2012 | Greiss et al. | |
| 8,249,861 | B2 | 8/2012 | Li et al. | |
| 2002/0007280 | A1 | 1/2002 | McCree | |
| 2002/0097807 | A1 | 7/2002 | Gerrits | |
| 2002/0138268 | A1 | 9/2002 | Gustafsson | |
| 2003/0009327 | A1 | 1/2003 | Nilsson et al. | |
| 2003/0050786 | A1 | 3/2003 | Jax et al. | |
| 2003/0093278 | A1 | 5/2003 | Malah | |
| 2003/0187663 | A1 | 10/2003 | Truman et al. | |
| 2004/0078205 | A1 | 4/2004 | Liljeryd et al. | |
| 2004/0128130 | A1* | 7/2004 | Rose et al. | 704/236 |
| 2004/0174911 | A1 | 9/2004 | Kim et al. | |
| 2004/0247037 | A1 | 12/2004 | Honma et al. | |
| 2005/0004793 | A1 | 1/2005 | Ojala et al. | |
| 2005/0065784 | A1* | 3/2005 | McAulay et al. | 704/205 |
| 2005/0094828 | A1 | 5/2005 | Sugimoto | |
| 2005/0143985 | A1 | 6/2005 | Sung et al. | |
| 2005/0143989 | A1 | 6/2005 | Jelinek | |
| 2005/0143997 | A1 | 6/2005 | Huang et al. | |
| 2005/0165611 | A1 | 7/2005 | Mehrotra et al. | |
| 2005/0171785 | A1 | 8/2005 | Nomura et al. | |
| 2006/0224381 | A1 | 10/2006 | Makinen | |
| 2006/0282262 | A1 | 12/2006 | Vos et al. | |
| 2006/0293016 | A1 | 12/2006 | Giesbrecht et al. | |
| 2007/0033023 | A1 | 2/2007 | Sung et al. | |
| 2007/0109977 | A1 | 5/2007 | Mittal et al. | |
| 2007/0124140 | A1 | 5/2007 | Iser et al. | |
| 2007/0150269 | A1 | 6/2007 | Nongpiur et al. | |
| 2007/0208557 | A1 | 9/2007 | Li et al. | |
| 2007/0238415 | A1 | 10/2007 | Sinha et al. | |
| 2008/0004866 | A1 | 1/2008 | Virolainen et al. | |
| 2008/0027717 | A1* | 1/2008 | Rajendran et al. | 704/210 |
| 2008/0120117 | A1 | 5/2008 | Choo et al. | |
| 2008/0177532 | A1 | 7/2008 | Greiss et al. | |
| 2009/0144062 | A1 | 6/2009 | Ramabadran et al. | |
| 2009/0198498 | A1 | 8/2009 | Ramabadran et al. | |
| 2009/0201983 | A1* | 8/2009 | Jasiuk et al. | 375/240 |
| 2010/0049342 | A1 | 2/2010 | Ramabadran et al. | |
| 2011/0112844 | A1 | 5/2011 | Jasiuk et al. | |
| 2011/0112845 | A1 | 5/2011 | Jasiuk et al. | |

FOREIGN PATENT DOCUMENTS

| | | | |
|---|---|---|---|
| EP | 1439524 | A1 | 7/2004 |
| EP | 1892703 | B1 | 10/2009 |
| JP | 90166198 | A | 1/1997 |
| KR | 1020050010744 | A | 1/2005 |
| KR | 1020060085118 | A | 7/2006 |
| WO | 9857436 | A2 | 12/1998 |
| WO | 02086867 | A1 | 10/2002 |
| WO | 2009070387 | A1 | 6/2009 |
| WO | 2009099835 | A1 | 8/2009 |

OTHER PUBLICATIONS

EPC Communication pursuant to Article 94(3), for App. No. 09707285.4, mailed Dec. 12, 2011, all pages.

Chan et al., "Wideband Enhancement of Narrowband Coded Speech Using MBE Re-Synthesis" (IEEE) 3rd International Conference on Signal Processing, 1996; pp. 667-670 vol. 1.

Enbom et al, "Bandwidth Expansion of Speech Based on Vector Quantization of the Mel Frequency Cepstral Coefficients" 1999 IEEE Workshop on Speech Coding Proceedings, pp. 171-173.

Makhoul et al., "High-Frequency Regeneration in Speech Coding Systems" IEEE International Conference on Acoustics, Speech and Signal Processing, ICASSP '79; pp. 428-431.

McCree et al., "A 14 kb/s Wideband Speech Coder with a Parametric Highband Model" 2000 IEEE International Conference on Acoustics, Speech and Signal Processing; ICASSP '00; pp. 1153-1156.

Miet et al., "Low-Band Extension of Telephone-Band Speech" 2000 IEEE International Conference on Acoustics, Speech and Signal Processing; ICASSP '00; pp. 1851-1854.

Yasukawa, M. "Implementation of Frequency Domain Digital Filter for Speech Enhancement" Proceeding of the Third IEEE International Conference on Electronics, Circuits and Systems, 1996; ICECS Proceedings vol. 1 pp. 518-521.

Nakatoh, Y. et al., "Generation of Broadband Speech from Narrowband Speech using Piecewise Linear mapping", in EUROSPEECH—1997, 1643-1646.

Epps, Julien, "Wideband Extension of Narrowband Speech for Enhancement and Coding", a thesis submitted to fulfill the requirements of the degree of Doctor of Philosophy, Sep. 2000, University of New South Wales.

Gustafsson, Harald; Lindgren, Ulf A.; Claesson, Ingvar, "Low-Complexity Feature-Mapped Speech Bandwidth Extension", IEEE Transactions on Audio, Speech, and Language Processing, Mar. 2006, vol. 14, No. 2, Sweden.

International Search Report and Written Opinion; International Application No. PCT/US2010/022879; dated May 7, 2010.

3rd General Partnership Project; Technical Specification Group Services and System Aspects; Speech Codec speech processing functions; AMR Wideband Speech Code; General Description (Release 5); Global System for Mobile Communications; 3GPP TS 26.171; V5.0.0; Mar. 2001.

Deller, Jr., John R. et al.; Discrete-Time Processing of Speech Signals; pp. 266-281; 1993.

Iser, Bernd et al.; Neural Networks Versus Codebooks in an Application for Bandwidth Extension of Speech Signals; 2003.

General Aspects of Digital Transmission Systems; Terminal Equipments; 7 kHz Audio-Coding Within 64 KBIT/S; International Telecommunication Union; 1988.

Henn, F. et al.; Spectral Band Replication (SBR) Technology and its Application in Broadcasting; 2003.

Tolba, Hesham et al.; On the Application of the AM-FM Model for the Recovery of Missing Frequency Bands of Telephone Speech; ICSLP Proceedings; pp. 1115-1118; 1998.

Jasiuk, Mark et al.; An Adaptive Equalizer for Analysis-by-Synthesis Speech Coders; EUSIPCO Proceedings; 2006.

Jax, Peter et al.; Wideband Extension of Telephone Speech Using a Hidden Markov Model; Institute of Communication Systems and Data Processing; IEEE; pp. 133-135; 2000.

Laaksonen, Laura et al.; Artificial Bandwidth Expansion Method to Improve Intelligibility and Quality of AMR-Coded Narrowband Speech; Multimedia Technologies Laboratory and Helsinki University of Technology; IEEE; pp. I-809-I-812; 2005.

Nilsson, Mattias et al.; Avoiding Over-Estimation in Bandwidth Extension of Telephony Speech; Department of Speech, Music and Hearing, KTH (Royal Institute of Technology); IEEE; pp. 869-872; 2001.

Carl, Holger et al.; Bandwidth Enhancement of Narrow-Band Speech Signals; Supplied by The British Library; 1993.

Rabiner, L.R. et al.; Digital Processing of Speech Signals; Prentice-Hall; pp. 274-277; 1978.

Epps, J. et al.; Speech Enhancement Using STC-Based Bandwidth Extension; ; section 3.6; Oct. 1, 1998.

Kornagel, Ulrich; Improved Artificial Low-Pass Extension of Telephone Speech; International Workshop on Acoustic Echo and Noise Control (IWAENC2003); Sep. 2003.

Park, Kun-Youl et al.; Narrowband to Wideband Conversion of Speech Using GMM Based Transformation; ICASSP Proceedings; pp. 1843-1846; 2000.

Kontio, Juho et al.; Neural Network-Based Artificial Bandwidth Expansion of Speech; IEEE Transaction on Audio, Speech and Language Processing; IEEE; pp. 1-9; 2006.

Cheng, Yan Ming et al.; Statistical Recovery of Wideband Speech From Narrowband Speech; IEEE; vol. 2, No. 4; pp. 544-548; Oct. 1994.

Uysal, Ismail et al.; Bandwidth Extension of Telephone Speech Using Frame-Based Excitation and Robust Features; Computational NeuroEngineering Laboratory, The University of Florida; 1989.

Nilsson, Mattias; On the Mutual Information Between Frequency Bands in Speech; ICASSP Proceedings pp. 1327-1330; 2000.

Larsen et al.: "Efficient high-frequency bandwidth extension of music and speech", Audio Engineering Society Convention Paper, Presented at the 112th Convention, May 2002, all pages.

J. Epps et al.,"A New Technique for Wideband Enhancement of Coded Narrowband Speech," Proc. 1999 IEEE Workshop on Speech Coding, pp. 174-176, Porvoo, Finland, Jun. 1999.
Chennoukh et al.: "Speech Enhancement Via Frequency Bandwidth Extension Using Line Spectral Frequencies", 2001, IEEE, Phillips Research Labs, pp. 665-658.
Martine Wolters et al., "A closer look into MPEG-4 High Efficiency AAC," Audio Engineering Society Convention Paper presented at the 115th Convention, Oct. 10-13, 2003, New York, USA.
Arora, et al., "High Quality Blind Bandwidth Extension of Audio for Portable Player Applications," Proceedings of the AES 120th Convention, May 20-23, 2006, Paris, France, pp. 1-6.
Annadana, et al., "A Novel Audio Post-Processing Toolkit for the Enhancement of Audio Signals Coded at Low Bit Rates," Proceedings of the AES 123rd Convention, Oct. 5-8, 2007, New York, NY, USA, pp. 1-7.
Chinese Patent Office (SIPO) Second Office Action for Chinese Patent Application No. 200980103691.5 dated Aug. 3, 2012, 12 pages.
United States Patent and Trademark Office, "Final Rejection" for U.S. Appl. No. 11/946,978 dated Sep. 10, 2012, 16 pages.
United States Patent and Trademark Office, "Notice of Allowance and Fee(s) Due" for U.S. Appl. No. 12/024,620 dated Nov. 13, 2012, 12 pages.
The State Intellectual Property Office of the People's Republic of China, Notification of Third Office Action for Chinese Patent Application No. 200980104372.6 dated Oct. 25, 2012, 10 pages.
European Patent Office, "Exam Report" for European Patent Application No. 08854969.6 dated Feb. 21, 2013, 4 pages.
Russian Federation, "Decision on Grant" for Russian Patent Application No. 2011110493 dated Dec. 17, 2012, 4 pages.

* cited by examiner

BANDWIDTH EXTENSION METHOD AND APPARATUS FOR A MODIFIED DISCRETE COSINE TRANSFORM AUDIO CODER

CROSS-REFERENCE TO RELATED APPLICATIONS

The present disclosure is related to: U.S. patent application Ser. No. 11/946,978, filed Nov. 29, 2007, entitled METHOD AND APPARATUS TO FACILITATE PROVISION AND USE OF AN ENERGY VALUE TO DETERMINE A SPECTRAL ENVELOPE SHAPE FOR OUT-OF-SIGNAL BANDWIDTH CONTENT; U.S. patent application Ser. No. 12/024,620, filed Feb. 1, 2008, entitled METHOD AND APPARATUS FOR ESTIMATING HIGH-BAND ENERGY IN A BANDWIDTH EXTENSION SYSTEM; U.S. patent application Ser. No. 12/027,571, filed Feb. 7, 2008, entitled METHOD AND APPARATUS FOR ESTIMATING HIGH-BAND ENERGY IN A BANDWIDTH EXTENSION SYSTEM; all of which are incorporated by reference herein.

FIELD OF THE DISCLOSURE

The present disclosure is related to audio coders and rendering audible content and more particularly to bandwidth extension techniques for audio coders.

BACKGROUND

Telephonic speech over mobile telephones has usually utilized only a portion of the audible sound spectrum, for example, narrow-band speech within the 300 to 3400 Hz audio spectrum. Compared to normal speech, such narrow-band speech has a muffled quality and reduced intelligibility. Therefore, various methods of extending the bandwidth of the output of speech coders, referred to as "bandwidth extension" or "BWE," may be applied to artificially improve the perceived sound quality of the coder output.

Although BWE schemes may be parametric or non-parametric, most known BWE schemes are parametric. The parameters arise from the source-filter model of speech production where the speech signal is considered as an excitation source signal that has been acoustically filtered by the vocal tract. The vocal tract may be modeled by an all-pole filter, for example, using linear prediction (LP) techniques to compute the filter coefficients. The LP coefficients effectively parameterize the speech spectral envelope information. Other parametric methods utilize line spectral frequencies (LSF), mel-frequency cepstral coefficients (MFCC), and log-spectral envelope samples (LES) to model the speech spectral envelope.

Many current speech/audio coders utilize the Modified Discrete Cosine Transform (MDCT) representation of the input signal and therefore BWE methods are needed that could be applied to MDCT based speech/audio coders.

DETAILED DESCRIPTION

The present disclosure provides a method for bandwidth extension in a coder and includes defining a transition band for a signal having a spectrum within a first frequency band, where the transition band is defined as a portion of the first frequency band, and is located near an adjacent frequency band that is adjacent to the first frequency band. The method analyzes the transition band to obtain a transition band spectral envelope and a transition band excitation spectrum; estimates an adjacent frequency band spectral envelope; generates an adjacent frequency band excitation spectrum by periodic repetition of at least a part of the transition band excitation spectrum with a repetition frequency determined by a pitch frequency of the signal; and combines the adjacent frequency band spectral envelope and the adjacent frequency band excitation spectrum to obtain an adjacent frequency band signal spectrum. A signal processing logic for performing the method is also disclosed.

In accordance with the embodiments, bandwidth extension may be implemented, using at least the quantized MDCT coefficients generated by a speech or audio coder modeling one frequency band, such as 4 to 7 kHz, to predict MDCT coefficients which model another frequency band, such as 7 to 14 kHz.

Figure 1:
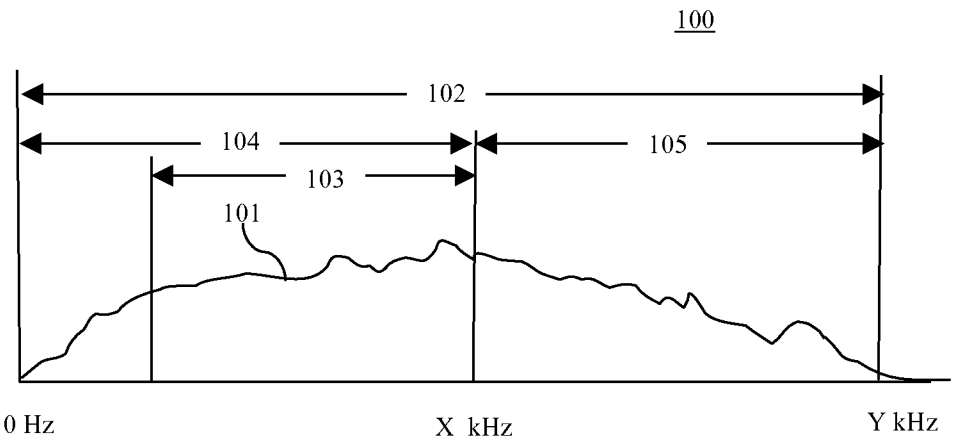
FIG. 1 is a diagram of an audio signal having a transition band near a high frequency band that is used in the embodiments to estimate the high frequency band signal spectrum.

Turning now to the drawings wherein like numerals represent like components, FIG. 1 is a graph 100, which is not to scale, that represents an audio signal 101 over an audible spectrum 102 ranging from 0 to Y kHz. The signal 101 has a low band portion 104, and a high band portion 105 which is not reproduced as part of low band speech. In accordance with the embodiments, a transition band 103 is selected and utilized to estimate the high band portion 105. The input signal may be obtained in various manners. For example, the signal 101 may be speech received over a digital wireless channel of a communication system, sent to a mobile station. The signal 101 may also be obtained from memory, for example, in an audio playback device from a stored audio file.

Figure 2:
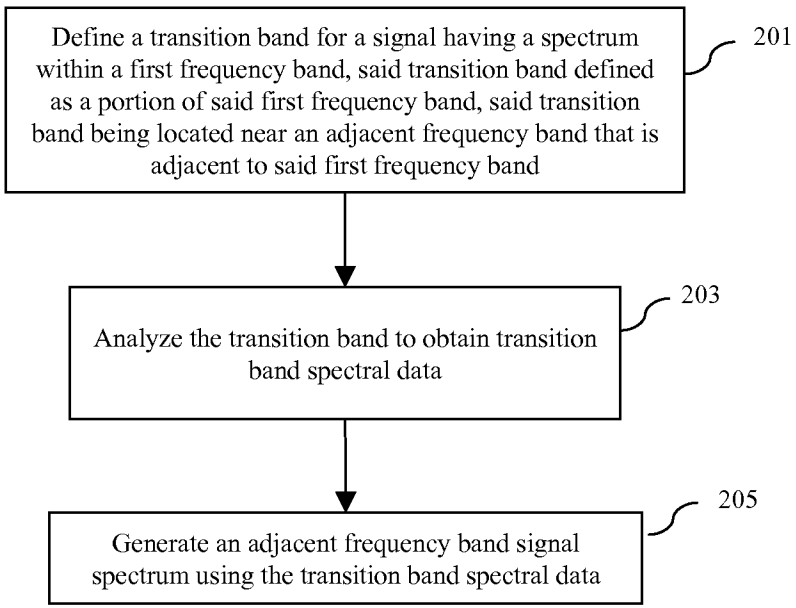
FIG. 2 is a flow chart of basic operation of a coder in accordance with the embodiments.

FIG. 2 illustrates the basic operation of a coder in accordance with the embodiments. In 201 a transition band 103 is defined within a first frequency band 104 of the signal 101. The transition band 103 is defined as a portion of the first frequency band and is located near the adjacent frequency band (such as high band portion 105). In 203 the transition band 103 is analyzed to obtain transition band spectral data, and, in 205, the adjacent frequency band signal spectrum is generated using the transition band spectral data.

Figure 3:
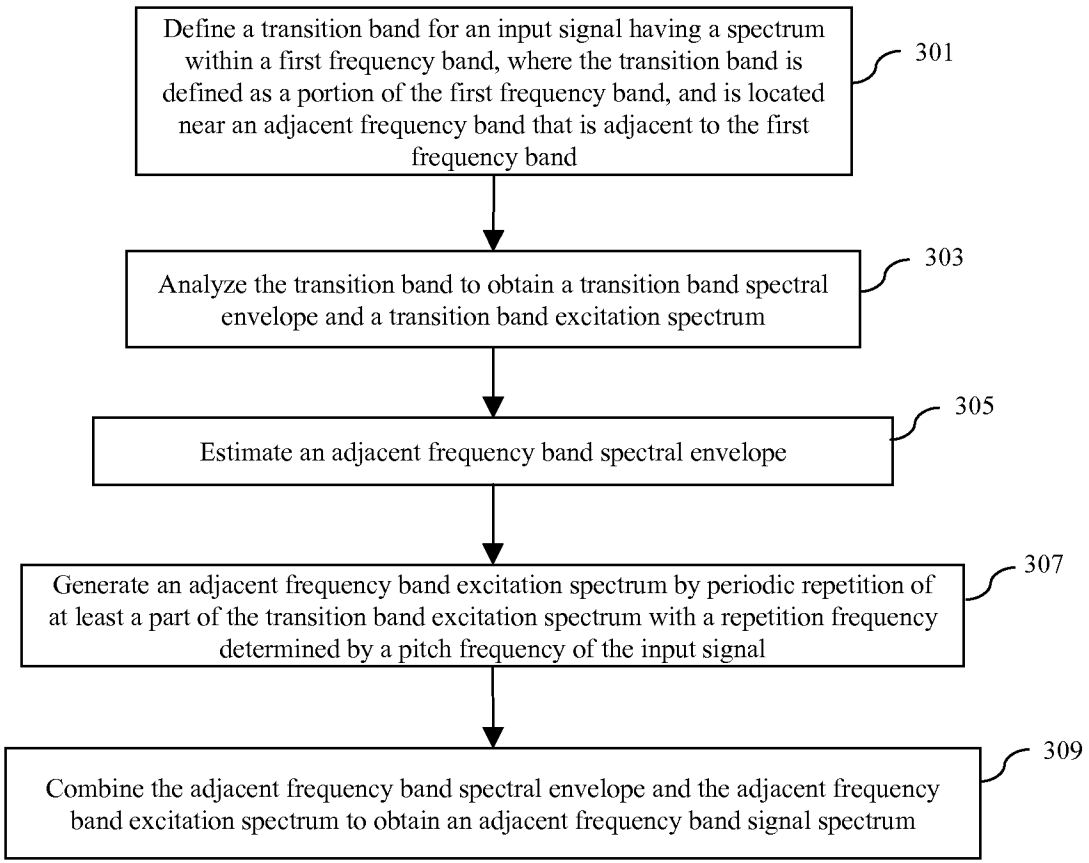
FIG. 3 is a flow chart showing further details of operation of a coder in accordance with the embodiments.

FIG. 3 illustrates further details of operation for one embodiment. In 301 a transition band is defined similar to 201. In 303, the transition band is analyzed to obtain transition band spectral data that includes the transition band spectral envelope and a transition band excitation spectrum. In 305, the adjacent frequency band spectral envelope is estimated. The adjacent frequency band excitation spectrum is then generated, as shown in 307, by periodic repetition of at least a part of the transition band excitation spectrum with a repetition frequency determined by a pitch frequency of the input signal. As shown in 309, the adjacent frequency band spectral envelope and the adjacent frequency band excitation spectrum may be combined to obtain a signal spectrum for the adjacent frequency band.

Figure 4:
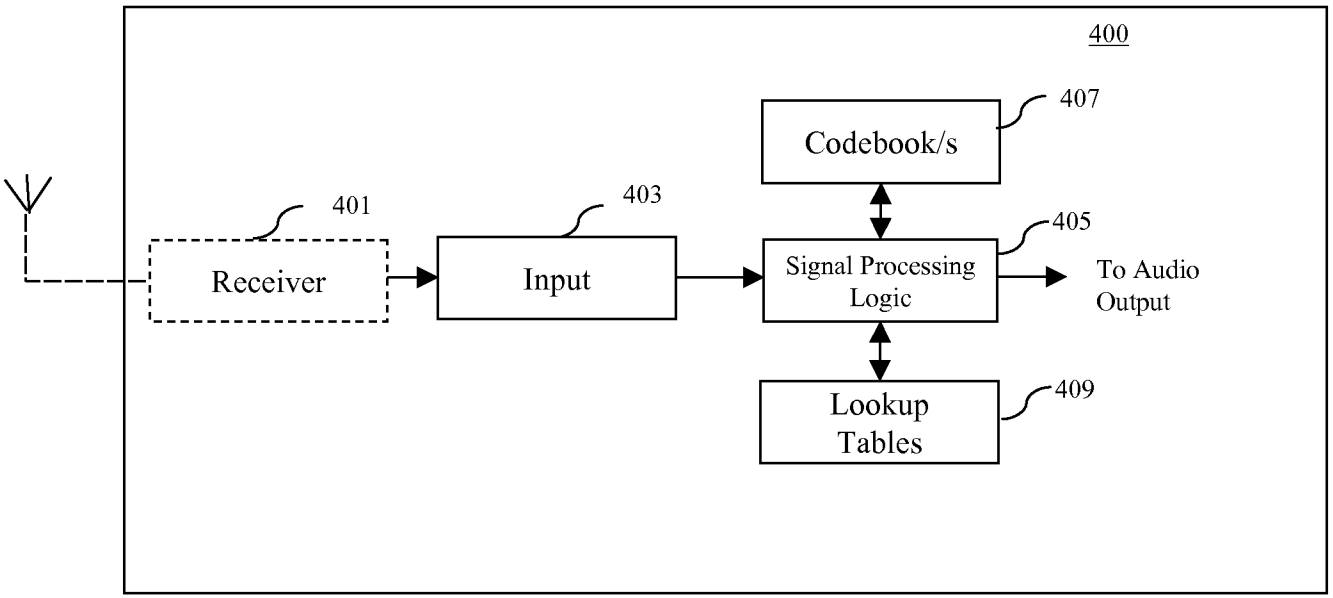
FIG. 4 is a block diagram of a communication device employing a coder in accordance with the embodiments.

FIG. 4 is a block diagram illustrating the components of an electronic device 400 in accordance with the embodiments. The electronic device may be a mobile station, a laptop computer, a personal digital assistant (PDA), a radio, an audio player (such as an MP3 player) or any other suitable device that may receive an audio signal, whether via wire or wireless transmission, and decode the audio signal using the methods and apparatuses of the embodiments herein disclosed. The electronic device 400 will include an input portion 403 where an audio signal is provided to a signal processing logic 405 in accordance with the embodiments.

Figure 5:
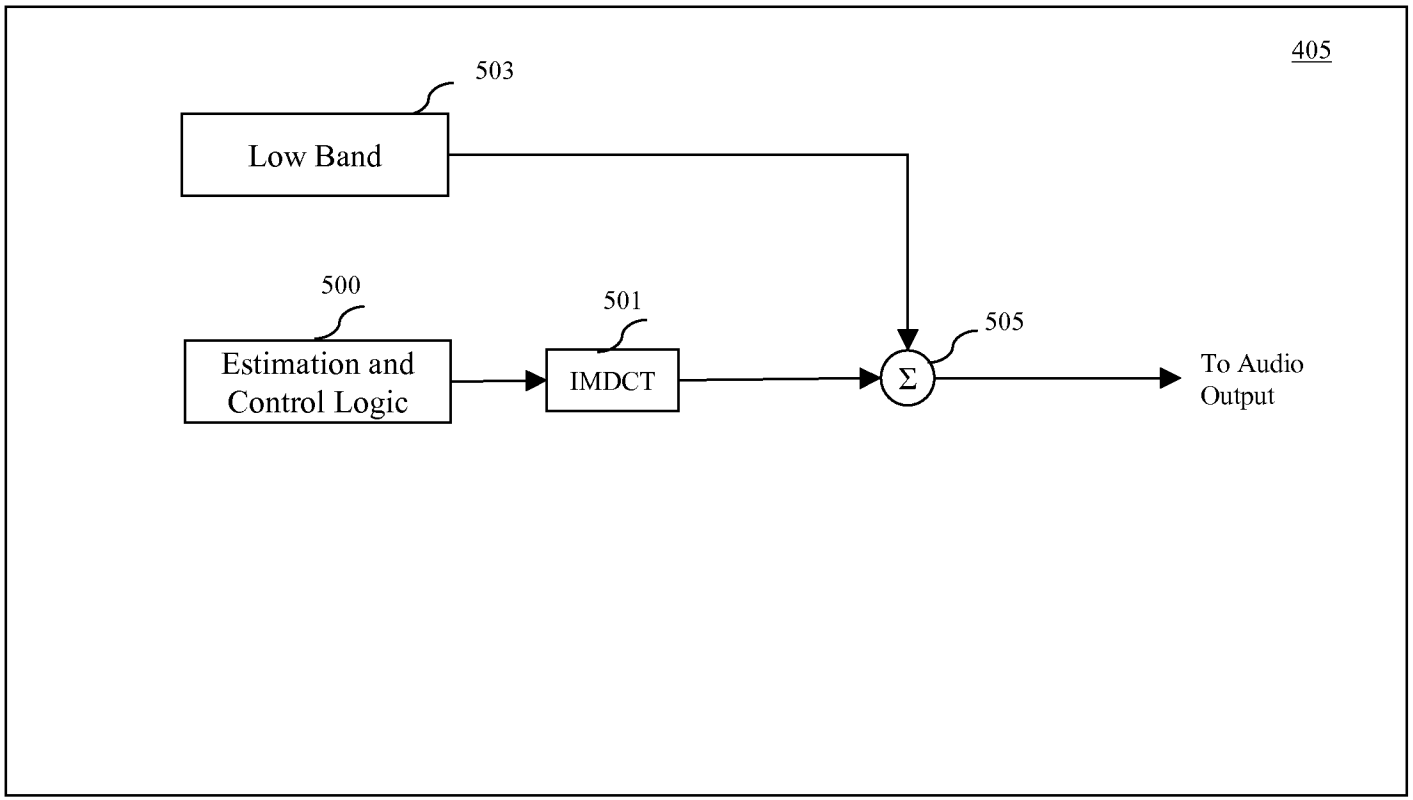
FIG. 5 is a block diagram of a coder in accordance with the embodiments.
Figure 6:
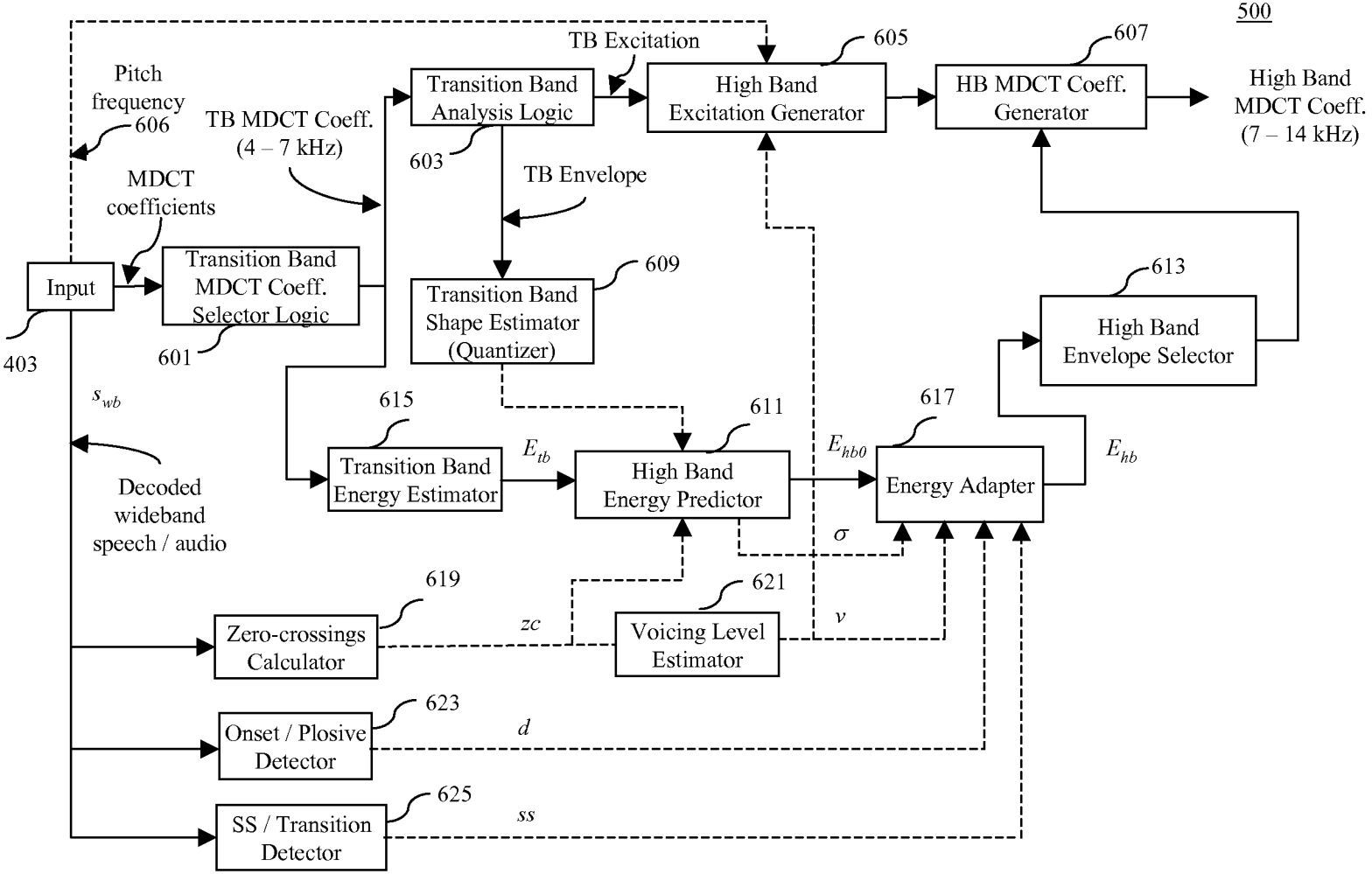
FIG. 6 is a block diagram of a coder in accordance with an embodiment.

It is to be understood that FIG. 4, as well as FIG. 5 and FIG. 6, are for illustrative purposes only, for the purpose of illustrating to one of ordinary skill, the logic necessary for making and using the embodiments herein described. Therefore, the Figures herein are not intended to be complete schematic diagrams of all components necessary for, for example, implementing an electronic device, but rather show only that which is necessary to facilitate an understanding, by one of ordinary skill, how to make and use the embodiments herein described. Therefore, it is also to be understood that various arrangements of logic, and any internal components shown, and any corresponding connectivity there-between, may be utilized and that such arrangements and corresponding connectivity would remain in accordance with the embodiments herein disclosed.

The term "logic" as used herein includes software and/or firmware executing on one or more programmable processors, ASICs, DSPs, hardwired logic or combinations thereof Therefore, in accordance with the embodiments, any described logic, including for example, signal processing logic 405, may be implemented in any appropriate manner and would remain in accordance with the embodiments herein disclosed.

The electronic device 400 may include a receiver, or transceiver, front end portion 401 and any necessary antenna or antennas for receiving a signal. Therefore receiver 401 and/or input logic 403, individually or in combination, will include all necessary logic to provide appropriate audio signals to the signal processing logic 405 suitable for further processing by the signal processing logic 405. The signal processing logic 405 may also include a codebook or codebooks 407 and lookup tables 409 in some embodiments. The lookup tables 409 may be spectral envelope lookup tables.

FIG. 5 provides further details of the signal processing logic 405. The signal processing logic 405 includes an estimation and control logic 500, which determines a set of MDCT coefficients to represent the high band portion of an audio signal. An Inverse-MDCT, IMDCT 501 is used to convert the signal to the time-domain which is then combined with the low band portion of the audio signal 503 via a summation operation 505 to obtain a bandwidth extended audio signal. The bandwidth extended audio signal is then output to an audio output logic (not shown).

Further details of some embodiments are illustrated by FIG. 6, although some logic illustrated may not, and need not, be present in all embodiments. For purposes of illustration, in the following, the low band is considered to cover the range from 50 Hz to 7 kHz (nominally referred to as the wideband speech/audio spectrum) and the high band is considered to cover the range from 7 kHz to 14 kHz. The combination of low and high bands, i.e. the range from 50 Hz to 14 kHz, is nominally referred to as the super-wideband speech/audio spectrum. Clearly, other choices for the low and high bands are possible and would remain in accordance with embodiments. Also, for purposes of illustration, the input block 403, which is part of the baseline coder, is shown to provide the following signals: i) the decoded wideband speech/audio signal $s_{wb}$, ii) the MDCT coefficients corresponding to at least the transition band, and iii) the pitch frequency 606 or the corresponding pitch period/delay. The input block 403, in some embodiments, may provide only the decoded wideband speech/audio signal and the other signals may, in this case, be derived from it at the decoder. As illustrated in FIG. 6, from the input block 403, a set of quantized MDCT coefficients is selected in 601 to represent a transition band. For example, the frequency band of 4 to 7 kHz may be utilized as a transition band; however other spectral portions may be used and would remain in accordance with the embodiments.

Next the selected transition band MDCT coefficients are used, along with selected parameters computed from the decoded wideband speech/audio (for example up to 7 kHz), to generate an estimated set of MDCT coefficients so as to specify signal content in the adjacent band, for example, from 7-14 kHz. The selected transition band MDCT coefficients are thus provided to transition band analysis logic 603 and transition band energy estimator 615. The energy in the quantized MDCT coefficients, representing the transition band, is computed by the transition band energy estimator logic 615. The output of transition band energy estimator logic 615 is an energy value and is closely related to, although not identical to, the energy in the transition band of the decoded wideband speech/audio signal.

The energy value determined in 615 is input to high band energy predictor 611, which is a non-linear energy predictor that computes the energy of the MDCT coefficients modeling the adjacent band, for example the frequency band of 7-14 kHz. In some embodiments, to improve the high band energy predictor 611 performance, the high band energy predictor 611 may use zero-crossings from the decoded speech, calculated by zero crossings calculator 619, in conjunction with the spectral envelope shape of the transition band spectral portion determined by transition band shape estimator 609. Depending on the zero crossing value and the transition band shape, different non-linear predictors are used thus leading to enhanced predictor performance. In designing the predictors, a large training database is first divided into a number of partitions based on the zero crossing value and the transition band shape and for each of the partitions so generated, separate predictor coefficients are computed.

Specifically, the output of the zero crossings calculator 619 may be quantized using an 8-level scalar quantizer that quantizes the frame zero-crossings and, likewise, the transition band shape estimator 609 may be an 8-shape spectral envelope vector quantizer (VQ) that classifies the spectral envelope shape. Thus at each frame at most 64 (i.e., 8×8) nonlinear predictors are provided, and a predictor corresponding to the selected partition is employed at that frame. In most embodiments, fewer than 64 predictors are used, because some of the 64 partitions are not assigned a sufficient number of frames from the training database to warrant their inclusion, and those partitions may be consequently merged with the nearby partitions. A separate energy predictor (not shown), trained over low energy frames, may be used for such low-energy frames in accordance with the embodiments.

To compute the spectral envelope corresponding to the transition band (4-7 kHz), the MDCT coefficients, representing the signal in that band, are first processed in block 603 by an absolute-value operator. Next, the processed MDCT coefficients which are zero-valued are identified, and the zeroed-out magnitudes are replaced by values obtained through a linear interpolation between the bounding non-zero valued MDCT magnitudes, which have been scaled down (for example, by a factor of 5) prior to applying the linear interpolation operator. The elimination of zero-valued MDCT coefficients as described above reduces the dynamic range of the MDCT magnitude spectrum, and improves the modeling efficiency of the spectral envelope computed from the modified MDCT coefficients.

The modified MDCT coefficients are then converted to the dB domain, via 20*log 10(x) operator (not shown). In the band from 7 to 8 kHz, the dB spectrum is obtained by spectral folding about a frequency index corresponding to 7 kHz, to further reduce the dynamic range of the spectral envelope to be computed for the 4-7 kHz frequency band. An Inverse Discrete Fourier Transform (IDFT) is next applied to the dB spectrum thus constructed for the 4-8 kHz frequency band, to compute the first 8 (pseudo-)cepstral coefficients. The dB spectral envelope is then calculated by performing a Discrete Fourier Transform (DFT) operation upon the cepstral coefficients.

The resulting transition band MDCT spectral envelope is used in two ways. First, it forms an input to the transition band spectral envelope vector quantizer, that is, to transition band shape estimator 609, which returns an index of the pre-stored spectral envelope (one of 8) which is closest to the input spectral envelope. That index, along with an index (one of 8) returned by a scalar quantizer of the zero-crossings computed from the decoded speech, is used to select one of the at most 64 non-linear energy predictors, as previously detailed. Secondly, the computed spectral envelope is used to flatten the spectral envelope of the transition band MDCT coefficients. One way in which this may be done is to divide each transition band MDCT coefficient by its corresponding spectral envelope value. The flattening may also be implemented in the log domain, in which case the division operation is replaced by a subtraction operation. In the latter implementation, the MDCT coefficient signs (or polarities) are saved for later reinstatement, because the conversion to log domain requires positive valued inputs. In the embodiments, the flattening is implemented in the log domain.

The flattened transition-band MDCT coefficients (representing the transition band MDCT excitation spectrum) output by block 603 are then used to generate the MDCT coefficients which model the excitation signal in the band from 7-14 kHz. In one embodiment the range of MDCT indices corresponding to the transition band may be 160 to 279, assuming that the initial MDCT index is 0 and 20 ms frame size at 32 kHz sampling. Given the flattened transition-band MDCT coefficients, the MDCT coefficients representing the excitation for indices 280 to 559 corresponding to the 7-14 kHz band are generated, using the following mapping:

$$\mathrm{MDCT}_{exc}(i)=\mathrm{MDCT}_{exc}(i-D), i=280, \ldots, 559, \quad D<=120.$$

The value of frequency delay D, for a given frame, is computed from the value of long term predictor (LTP) delay for the last subframe of the 20 ms frame which is part of the core codec transmitted information. From this decoded LTP delay, an estimated pitch frequency value for the frame is computed, and the biggest integer multiple of this pitch frequency value is identified, to yield a corresponding integer frequency delay value D (defined in the MDCT index domain) which is less than or equal to 120. This approach ensures the reuse of the flattened transition-band MDCT information thus preserving the harmonic relationship between the MDCT coefficients in the 4-7 kHz band and the MDCT coefficients being estimated for the 7-14 kHz band. Alternately, MDCT coefficients computed from a white noise sequence input may be used to form an estimate of flattened MDCT coefficients in the band from 7-14 kHz. Either way, an estimate of the MDCT coefficients representative of the excitation information in the 7-14 kHz band is formed by the high band excitation generator 605.

The predicted energy value of the MDCT coefficients in the band from 7-14 kHz output by the non-linear energy predictor may be adapted by energy adapter logic 617 based on the decoded wideband signal characteristics to minimize artifacts and enhance the quality of the bandwidth extended output speech. For this purpose, the energy adapter 617 receives the following inputs in addition to the predicted high band energy value: i) the standard deviation σ of the prediction error from high band energy predictor 611, ii) the voicing level v from the voicing level estimator 621, iii) the output d of the onset/plosive detector 623, and iv) the output ss of the steady-state/transition detector 625.

Given the predicted and adapted energy value of the MDCT coefficients in the band from 7-14 kHz, the spectral envelope consistent with that energy value is selected from a codebook 407. Such a codebook of spectral envelopes modeling the spectral envelopes which characterize the MDCT coefficients in the 7-14 kHz band and classified according to the energy values in that band is trained off-line. The envelope corresponding to the energy class closest to the predicted and adapted energy value is selected by high band envelope selector 613.

The selected spectral envelope is provided by the high band envelope selector 613 to the high band MDCT generator 607, and is then applied to shape the MDCT coefficients modeling the flattened excitation in the band from 7-14 kHz. The shaped MDCT coefficients corresponding to the 7-14 kHz band representing the high band MDCT spectrum are next applied to an inverse modified cosine transform (IMDCT) 501, to form a time domain signal having content in the 7-14 kHz band. This signal is then combined by, for example summation operation 505, with the decoded wideband signal having content up to 7 kHz, that is, low band portion 503, to form the bandwidth extended signal which contains information up to 14 kHz.

By one approach, the aforementioned predicted and adapted energy value can serve to facilitate accessing a look-up table 409 that contains a plurality of corresponding candidate spectral envelope shapes. To support such an approach, this apparatus can also comprise, if desired, one or more look-up tables 409 that are operably coupled to the signal processing logic 405. So configured, the signal processing logic 405 can readily access the look-up tables 409 as appropriate.

It is to be understood that the signal processing discussed above may be performed by a mobile station in wireless communication with a base station. For example, the base station may transmit the wideband or narrow-band digital audio signal via conventional means to the mobile station. Once received, signal processing logic within the mobile station performs the requisite operations to generate a bandwidth extended version of the digital audio signal that is clearer and more audibly pleasing to a user of the mobile station.

Additionally in some embodiments, a voicing level estimator 621 may be used in conjunction with high band excitation generator 605. For example, a voicing level of 0, indicating unvoiced speech, may be used to determine use of noise excitation. Similarly, a voicing level of 1 indicating voiced speech, may be used to determine use of high band excitation derived from transition band excitation as described above. When the voicing level is in between 0 and 1 indicating mixed-voiced speech, various excitations may be mixed in appropriate proportion as determined by the voicing level and used. The noise excitation may be a pseudo random noise function and as described above, may be considered as filling or patching holes in the spectrum based on the voicing level. A mixed high band excitation is thus suitable for voiced, unvoiced, and mixed-voiced sounds.

FIG. 6 shows the Estimation and Control Logic 500 as comprising transition band MDCT coefficient selector logic 601, transition band analysis logic 603, high band excitation generator 605, high band MDCT coefficient generator 607, transition band shape estimator 609, high band energy predictor 611, high band envelope selector 613, transition band energy estimator 615, energy adapter 617, zero-crossings calculator 619, voicing level estimator 621, onset/plosive detector 623, and SS/Transition detector 625.

The input 403 provides the decoded wideband speech/audio signal $s_{wb}$, the MDCT coefficients corresponding to at least the transition band, and the pitch frequency (or delay) for each frame. The transition band MDCT selector logic 601 is part of the baseline coder and provides a set of MDCT coefficients for the transition band to the transition band analysis logic 603 and to the transition band energy estimator 615.

Voicing level estimation: To estimate the voicing level, a zero-crossing calculator 619 may calculate the number of zero-crossings zc in each frame of the wideband speech $s_{wb}$ as follows:

$$zc = \frac{1}{2(N-1)}\sum_{n=0}^{N-2}|\mathrm{Sgn}(s_{wb}(n)) - \mathrm{Sgn}(s_{wb}(n+1))|$$

where $$\mathrm{Sgn}(s_{wb}(n)) = \begin{cases} 1 & \text{if } s_{wb}(n) \geq 0 \\ -1 & \text{if } s_{wb}(n) < 0 \end{cases},$$

where n is the sample index, and N is the frame size in samples. The frame size and percent overlap used in the Estimation and Control Logic 500 are determined by the baseline coder, for example, N=640 at 32 kHz sampling frequency and 50% overlap. The value of the zc parameter calculated as above ranges from 0 to 1. From the zc parameter, a voicing level estimator 621 may estimate the voicing level v as follows.

$$v = \begin{cases} 1 & \text{if } zc < ZC_{low} \\ 0 & \text{if } zc > ZC_{high} \\ 1 - \left[\dfrac{zc - ZC_{low}}{ZC_{high} - ZC_{low}}\right] & \text{otherwise} \end{cases}$$

where, $ZC_{low}$ and $ZC_{high}$ represent appropriately chosen low and high thresholds respectively, e.g., $ZC_{low}$=0.125 and $ZC_{high}$=0.30.

In order to estimate the high band energy, a transition-band energy estimator 615 estimates the transition-band energy from the transition band MDCT coefficients. The transition-band is defined here as a frequency band that is contained within the wideband and close to the high band, i.e., it serves as a transition to the high band, (which, in this illustrative example, is about 7000-14,000 Hz). One way to calculate the transition-band energy $E_{tb}$ is to sum the energies of the spectral components, i.e. MDCT coefficients, within the transition-band.

From the transition-band energy $E_{tb}$ in dB (decibels), the high band energy $E_{hb0}$ in dB is estimated as $$E_{hb0}=\alpha E_{tb}+\beta$$

where, the coefficients α and β are selected to minimize the mean squared error between the true and estimated values of the high band energy over a large number of frames from a training speech/audio database.

The estimation accuracy can be further enhanced by exploiting contextual information from additional speech parameters such as the zero-crossing parameter zc and the transition-band spectral shape as may be provided by a transition-band shape estimator 609. The zero-crossing parameter, as discussed earlier, is indicative of the speech voicing level. The transition band shape estimator 609 provides a high resolution representation of the transition band envelope shape. For example, a vector quantized representation of the transition band spectral envelope shapes (in dB) may be used. The vector quantizer (VQ) codebook consists of 8 shapes referred to as transition band spectral envelope shape parameters tbs that are computed from a large training database. A corresponding zc-tbs parameter plane may be formed using the zc and tbs parameters to achieve improved performance. As described earlier, the zc-tbs plane is divided into 64 partitions corresponding to 8 scalar quantized levels of zc and the 8 tbs shapes. Some of the partitions may be merged with the nearby partitions for lack of sufficient data points from the training database. For each of the remaining partitions in the zc-tbs plane, separate predictor coefficients are computed.

The high band energy predictor 611 can provide additional improvement in estimation accuracy by using higher powers of $E_{tb}$ in estimating $E_{hb0}$, e.g., $$E_{hb0}=\alpha_4 E_{tb}^4+\alpha_3 E_{tb}^3+\alpha_2 E_{tb}^2+\alpha_1 E_{tb}+\beta.$$

In this case, five different coefficients, viz., $\alpha_4$, $\alpha_3$, $\alpha_2$, $\alpha_1$, and β, are selected for each partition of the zc-tbs parameter plane. Since the above equations for estimating $E_{hb0}$ are non-linear, special care must be taken to adjust the estimated high band energy as the input signal level, i.e, energy, changes. One way of achieving this is to estimate the input signal level in dB, adjust $E_{tb}$ up or down to correspond to the nominal signal level, estimate $E_{hb0}$, and adjust $E_{hb0}$ down or up to correspond to the actual signal level.

Estimation of the high band energy is prone to errors. Since over-estimation leads to artifacts, the estimated high band energy is biased to be lower by an amount proportional to the standard deviation of the estimation error of $E_{hb0}$. That is, the high band energy is adapted in energy adapter 617 as:

$$E_{hb1}=E_{hb0}-\lambda\cdot\sigma$$

where, $E_{hb1}$ is the adapted high band energy in dB, $E_{hb0}$ is the estimated high band energy in dB, $\lambda \geqq 0$ is a proportionality factor, and σ is the standard deviation of the estimation error in dB. Thus, after determining the estimated high band energy level, the estimated high band energy level is modified based on an estimation accuracy of the estimated high band energy. With reference to FIG. 6, high band energy predictor 611 additionally determines a measure of unreliability in the estimation of the high band energy level and energy adapter 617 biases the estimated high band energy level to be lower by an amount proportional to the measure of unreliability. In one embodiment the measure of unreliability comprises a standard deviation σ of the error in the estimated high band energy level. Other measures of unreliability may as well be employed without departing from the scope of the embodiments.

By "biasing down" the estimated high band energy, the probability (or number of occurrences) of energy over-estimation is reduced, thereby reducing the number of artifacts. Also, the amount by which the estimated high band energy is reduced is proportional to how good the estimate is—a more reliable (i.e., low σ value) estimate is reduced by a smaller amount than a less reliable estimate. While designing the high band energy predictor 611, the σ value corresponding to each partition of the zc-tbs parameter plane is computed from the training speech database and stored for later use in "biasing down" the estimated high band energy. The σ value of the (<=64) partitions of the zc-tbs parameter plane, for example, ranges from about 4 dB to about 8 dB with an average value of about 5.9 dB. A suitable value of λ for this high band energy predictor, for example, is 1.2.

In a prior-art approach, over-estimation of high band energy is handled by using an asymmetric cost function that penalizes over-estimated errors more than under-estimated errors in the design of the high band energy predictor 611. Compared to this prior-art approach, the "bias down" approach described herein has the following advantages: (A) The design of the high band energy predictor 611 is simpler because it is based on the standard symmetric "squared error" cost function; (B) The "bias down" is done explicitly during the operational phase (and not implicitly during the design phase) and therefore the amount of "bias down" can be easily controlled as desired; and (C) The dependence of the amount of "bias down" to the reliability of the estimate is explicit and straightforward (instead of implicitly depending on the specific cost function used during the design phase).

Besides reducing the artifacts due to energy over-estimation, the "bias down" approach described above has an added benefit for voiced frames—namely that of masking any errors in high band spectral envelope shape estimation and thereby reducing the resultant "noisy" artifacts. However, for unvoiced frames, if the reduction in the estimated high band energy is too high, the bandwidth extended output speech no longer sounds like super wide band speech. To counter this, the estimated high band energy is further adapted in energy adapter 617 depending on its voicing level as $$E_{hb2}=E_{hb1}+(1-v)\cdot\delta_1+v\cdot\delta_2$$

where, $E_{hb2}$ is the voicing-level adapted high band energy in dB, v is the voicing level ranging from 0 for unvoiced speech to 1 for voiced speech, and $\delta_1$ and $\delta_2$ ($\delta_1>\delta_2$) are constants in dB. The choice of $\delta_1$ and $\delta_2$ depends on the value of λ used for the "bias down" and is determined empirically to yield the best-sounding output speech. For example, when λ is chosen as 1.2, $\delta_1$ and $\delta_2$ may be chosen as 3.0 and −3.0 respectively. Note that other choices for the value of λ may result in different choices for $\delta_1$ and $\delta_2$—the values of $\delta_1$ and $\delta_2$ may both be positive or negative or of opposite signs. The increased energy level for unvoiced speech emphasizes such speech in the bandwidth extended output compared to the wideband input and also helps to select a more appropriate spectral envelope shape for such unvoiced segments.

With reference to FIG. 6, voicing level estimator 621 outputs a voicing level to energy adapter 617 which further modifies the estimated high band energy level based on wideband signal characteristics by further modifying the estimated high band energy level based on a voicing level. The further modifying may comprise reducing the high band energy level for substantially voiced speech and/or increasing the high band energy level for substantially unvoiced speech.

While the high band energy predictor 611 followed by energy adapter 617 works quite well for most frames, occasionally there are frames for which the high band energy is grossly under- or over-estimated. Some embodiments may therefore provide for such estimation errors and, at least partially, correct them using an energy track smoother logic (not shown) that comprises a smoothing filter. Thus the step of modifying the estimated high band energy level based on the wideband signal characteristics may comprise smoothing the estimated high band energy level (which has been previously modified as described above based on the standard deviation of the estimation σ and the voicing level v), essentially reducing an energy difference between consecutive frames.

For example, the voicing-level adapted high band energy $E_{hb2}$ may be smoothed using a 3-point averaging filter as $$E_{hb3}=[E_{hb2}(k-1)+E_{hb2}(k)+E_{hb2}(k+1)]/3$$

where, $E_{hb3}$ is the smoothed estimate and k is the frame index. Smoothing reduces the energy difference between consecutive frames, especially when an estimate is an "outlier", that is, the high band energy estimate of a frame is too high or too low compared to the estimates of the neighboring frames. Thus, smoothing helps to reduce the number of artifacts in the output bandwidth extended speech. The 3-point averaging filter introduces a delay of one frame. Other types of filters with or without delay can also be designed for smoothing the energy track.

The smoothed energy value $E_{hb3}$ may be further adapted by energy adapter 617 to obtain the final adapted high band energy estimate $E_{hb}$. This adaptation can involve either decreasing or increasing the smoothed energy value based on the ss parameter output by the steady-state/transition detector 625 and/or the d parameter output by the onset/plosive detector 623. Thus, the step of modifying the estimated high band energy level based on the wideband signal characteristics may include the step of modifying the estimated high band energy level (or previously modified estimated high band energy level) based on whether or not a frame is steady-state or transient. This may include reducing the high band energy level for transient frames and/or increasing the high band energy level for steady-state frames, and may further include modifying the estimated high band energy level based on an occurrence of an onset/plosive. By one approach, adapting the high band energy value changes not only the energy level but also the spectral envelope shape since the selection of the high band spectrum may be tied to the estimated energy.

A frame is defined as a steady-state frame if it has sufficient energy (that is, it is a speech frame and not a silence frame) and it is close to each of its neighboring frames both in a spectral sense and in terms of energy. Two frames may be considered spectrally close if the Itakura distance between the two frames is below a specified threshold. Other types of spectral distance measures may also be used. Two frames are considered close in terms of energy if the difference in the wideband energies of the two frames is below a specified threshold. Any frame that is not a steady-state frame is considered a transition frame. A steady state frame is able to mask errors in high band energy estimation much better than transient frames. Accordingly, the estimated high band energy of a frame is adapted based on the ss parameter, that is, depending on whether it is a steady-state frame (ss=1) or transition frame (ss=0) as $$E_{hb4}=\begin{cases}E_{hb3}+\mu_1 & \text{for steady-state frames}\\ \min(E_{hb3}-\mu_2,\ E_{hb2}) & \text{for transition frames}\end{cases}$$

where, $\mu_2>\mu_1\geqq 0$, are empirically chosen constants in dB to achieve good output speech quality. The values of $\mu_1$ and $\mu_2$ depend on the choice of the proportionality constant λ used for the "bias down". For example, when λ is chosen as 1.2, $\delta_1$ as 3.0, and $\delta_2$ as −3.0, $\mu_1$ and $\mu_2$ may be chosen as 1.5 and 6.0 respectively. Notice that in this example we are slightly increasing the estimated high band energy for steady-state frames and decreasing it significantly further for transition frames. Note that other choices for the values of $\lambda$, $\delta_1$, and $\delta_2$ may result in different choices for $\mu_1$ and $\mu_2$—the values of $\mu_1$ and $\mu_2$ may both be positive or negative or of opposite signs. Further, note that other criteria for identifying steady-state/transition frames may also be used.

Based on the onset/plosive detector 623 output d, the estimated high band energy level can be adjusted as follows: When d=1, it indicates that the corresponding frame contains an onset, for example, transition from silence to unvoiced or voiced sound, or a plosive sound. An onset/plosive is detected at the current frame if the wideband energy of the preceding frame is below a certain threshold and the energy difference between the current and preceding frames exceeds another threshold. In another implementation, the transition band energy of the current and preceding frames are used to detect an onset/plosive. Other methods for detecting an onset/plosive may also be employed. An onset/plosive presents a special problem because of the following reasons: A) Estimation of high band energy near onset/plosive is difficult; B) Pre-echo type artifacts may occur in the output speech because of the typical block processing employed; and C) Plosive sounds (e.g., [p], [t], and [k]), after their initial energy burst, have characteristics similar to certain sibilants (e.g., [s], [ʃ], and [3]) in the wideband but quite different in the high band leading to energy over-estimation and consequent artifacts. High band energy adaptation for an onset/plosive (d=1) is done as follows:

$$E_{hb}(k) = \begin{cases} E_{min} & \text{for } k = 1, \ldots, K_{min} \\ E_{hb4}(k) - \Delta & \text{for } k = K_{min}+1, \ldots, K_T \text{ if } v(k) > V_1 \\ E_{hb4}(k) - \Delta + \Delta_T(k - K_T) & \text{for } k = K_T+1, \ldots, K_{max} \text{ if } v(k) > V_1 \end{cases}$$

where k is the frame index. For the first $K_{min}$ frames starting with the frame (k=1) at which the onset/plosive is detected, the high band energy is set to the lowest possible value $E_{min}$. For example, $E_{min}$ can be set to $-\infty$ dB or to the energy of the high band spectral envelope shape with the lowest energy. For the subsequent frames (i.e., for the range given by $k=K_{min}+1$ to $k=K_{max}$), energy adaptation is done only as long as the voicing level v(k) of the frame exceeds the threshold $V_1$. Instead of the voicing level parameter, the zero-crossing parameter zc with an appropriate threshold may also be used for this purpose. Whenever the voicing level of a frame within this range becomes less than or equal to $V_1$, the onset energy adaptation is immediately stopped, that is, $E_{hb}(k)$ is set equal to $E_{hb4}(k)$ until the next onset is detected. If the voicing level v(k) is greater than $V_1$, then for $k=K_{min}+1$ to $k=K_T$, the high band energy is decreased by a fixed amount $\Delta$. For $k=K_T+1$ to $k=K_{max}$, the high band energy is gradually increased from $E_{hb4}(k)-\Delta$ towards $E_{hb4}(k)$ by means of the pre-specified sequence $\Delta_T(k-K_T)$ and at $k=K_{max}+1$, $E_{hb}(k)$ is set equal to $E_{hb4}(k)$, and this continues until the next onset is detected. Typical values of the parameters used for onset/plosive based energy adaptation, for example, are $K_{min}=2$, $K_T=3$, $K_{max}=5$, $V_1=0.9$, $\Delta=-12$ dB, $\Delta_T(1)=6$ dB, and $\Delta_T(2)=9.5$ dB. For d=0, no further adaptation of the energy is done, that is, $E_{hb}$ is set equal to $E_{hb4}$. Thus, the step of modifying the estimated high band energy level based on the wideband signal characteristics may comprise the step of modifying the estimated high band energy level (or previously modified estimated high band energy level) based on an occurrence of an onset/plosive.

The adaptation of the estimated high band energy as outlined above helps to minimize the number of artifacts in the bandwidth extended output speech and thereby enhance its quality. Although the sequence of operations used to adapt the estimated high band energy has been presented in a particular way, those skilled in the art will recognize that such specificity with respect to sequence is not a requirement, and as such, other sequences may be used and would remain in accordance with the herein disclosed embodiments. Also, the operations described for modifying the high band energy level may selectively be applied in the embodiments.

Therefore signal processing logic and methods of operation have been disclosed herein for estimating a high band spectral portion, in the range of about 7 to 14 kHz, and determining MDCT coefficients such that an audio output having a spectral portion in the high band may be provided. Other variations that would be equivalent to the herein disclosed embodiments may occur to those of ordinary skill in the art and would remain in accordance with the spirit and scope of embodiments as defined herein by the following claims.

What is claimed is:

1. A method comprising:

defining a transition band for a signal having a spectrum within a first frequency band, said transition band defined as a portion of said first frequency band, said transition band being located near an adjacent frequency band that is adjacent to said first frequency band;

analyzing said transition band to obtain transition band spectral data;

analyzing said transition band spectral data to obtain a transition band spectral envelope and a transition band excitation spectrum; and generating an adjacent frequency band signal spectrum using said transition band spectral data comprising:

estimating an adjacent frequency band spectral envelope;

generating an adjacent frequency band excitation spectrum, using said transition band spectral data; and combining said adjacent band spectral envelope and said adjacent frequency band excitation spectrum to generate said adjacent frequency band signal spectrum.

2. The method of claim 1, wherein generating an adjacent frequency band excitation spectrum, using said transition band spectral data, further comprises:

generating said adjacent frequency band excitation spectrum by periodic repetition of at least a part of said transition band excitation spectrum with a repetition period determined by a pitch frequency of said signal.

3. The method of claim 2, wherein generating said adjacent frequency band excitation spectrum, further comprises:

mixing said adjacent frequency band excitation spectrum generated by periodic repetition of at least a part of said transition band excitation spectrum with a pseudo-noise excitation spectrum within said adjacent frequency band.

4. The method of claim 3, further comprising:

determining a mixing ratio, for mixing said adjacent frequency band excitation spectrum and said pseudo-noise excitation spectrum, using a voicing level estimated from said signal.

5. The method of claim 4, further comprising:

filling any holes in said adjacent frequency band excitation spectrum due to corresponding holes in said transition band excitation spectrum using said pseudo-noise excitation spectrum.

6. The method of claim 1, wherein estimating an adjacent frequency band spectral envelope, further comprises:

estimating said signal's energy in said adjacent frequency band.

7. The method of claim 1, further comprising:

combining said spectrum within said first frequency band and said adjacent frequency band signal spectrum to obtain a bandwidth extended signal spectrum and a corresponding bandwidth extended signal.

8. A method comprising:

defining a transition band for a signal having a spectrum within a first frequency band, said transition band defined as a portion of said first frequency band, said transition band being located near an adjacent frequency band that is adjacent to said first frequency band;

analyzing said transition band to obtain a transition band spectral envelope and a transition band excitation spectrum;

estimating an adjacent frequency band spectral envelope;

generating an adjacent frequency band excitation spectrum by periodic repetition of at least a part of said transition band excitation spectrum with a repetition period determined by a pitch frequency of said signal; and combining said adjacent frequency band spectral envelope and said adjacent frequency band excitation spectrum to obtain an adjacent frequency band signal spectrum.

9. The method of claim 8, wherein estimating an adjacent frequency band spectral envelope, further comprises:

estimating said signal's energy in said adjacent frequency band.

10. The method of claim 9, further comprising:

combining said spectrum within said first frequency band and said adjacent frequency band signal spectrum to obtain a bandwidth extended signal spectrum and a corresponding bandwidth extended signal.

11. The method of claim 10, wherein generating said adjacent frequency band excitation spectrum, further comprises:

mixing said adjacent frequency band excitation spectrum generated by periodic repetition of at least a part of said transition band excitation spectrum with a pseudo-noise excitation spectrum within said adjacent frequency band.

12. The method of claim 9, further comprising:

determining a mixing ratio, for mixing said adjacent frequency band excitation spectrum and said pseudo-noise excitation spectrum, using a voicing level estimated from said signal.

13. The method of claim 9, further comprising:

filling any holes in said adjacent frequency band excitation spectrum due to corresponding holes in said transition band excitation spectrum using said pseudo-noise excitation spectrum.

14. A device comprising:

an input where a signal is provided;

a processor coupled to the input wherein the processor is configured to:

define a transition band for the signal having a spectrum within a first frequency band, said transition band defined as a portion of said first frequency band, said transition band being located near an adjacent frequency band that is adjacent to said first frequency band;

analyze said transition band to obtain a transition band spectral envelope and a transition band excitation spectrum;

estimate an adjacent frequency band spectral envelope;

generate an adjacent frequency band excitation spectrum by periodic repetition of at least a part of said transition band excitation spectrum with a repetition period determined by a pitch frequency of said signal; and combine said adjacent frequency band spectral envelope and said adjacent frequency band excitation spectrum to obtain an adjacent frequency band signal spectrum.

15. The device of claim 14, wherein said processor is further configured to:

estimate said signal's energy in said adjacent frequency band.

16. The device of claim 15, wherein said processor is further configured to:

combine said spectrum within said first frequency band and said adjacent frequency band signal spectrum to obtain a bandwidth extended signal spectrum and a corresponding bandwidth extended signal.

17. The device of claim 15, wherein said processor is further configured to:

mix said adjacent frequency band excitation spectrum generated by periodic repetition of at least a part of said transition band excitation spectrum with a pseudo-noise excitation spectrum within said adjacent frequency band.

18. The device of claim 17, wherein processor is further configured to:

determine a mixing ratio, for mixing said adjacent frequency band excitation spectrum and said pseudo-noise excitation spectrum, using a voicing level estimated from said signal.

19. The device of claim 18, wherein said processor is further configured to:

fill any holes in said adjacent frequency band excitation spectrum due to corresponding holes in said transition band excitation spectrum using said pseudo-noise excitation spectrum.

* * * * *